US005163632A

United States Patent [19]

Chilcoat et al.

[11] Patent Number: 5,163,632

[45] Date of Patent: Nov. 17, 1992

[54] MONO FILIMENT DISPENSER SPOOL WINDER

[76] Inventors: Charles C. Chilcoat, 103 S. Bettes, Wagoner, Okla. 74467; Kayfar Z. Bushey, P.O. Box 260741, Plano, Tex. 75026

[21] Appl. No.: 531,560

[22] Filed: Jun. 1, 1990

[51] Int. Cl.[5] ..... B64C 3/38; B64C 1/14

[52] U.S. Cl. ..... 242/47; 242/129.51

[58] Field of Search ..... 242/47, 53, 129.51, 242/129.7, 129.71, 129, 67.3 R, 68.3, 68.4

[56] References Cited

U.S. PATENT DOCUMENTS

| | | | |
|---|---|---|---|
| 2,022,409 | 11/1935 | Mott | 242/137.1 |
| 2,371,686 | 3/1945 | Gaulke | 242/137.1 |
| 2,445,534 | 7/1948 | Musso | 242/129.51 |
| 2,523,806 | 9/1950 | Bohne | 242/129.51 |
| 3,090,569 | 5/1963 | Beushausen | 242/129.51 |
| 3,194,713 | 7/1965 | Comet | 242/129.51 |
| 3,469,801 | 1/1968 | Hauck | 242/54 R |
| 3,584,808 | 6/1971 | Staples | 242/68.4 |
| 3,816,845 | 6/1974 | Rygiol | 242/137.1 X |
| 4,310,126 | 1/1982 | Norleen | 242/47 |
| 4,715,557 | 12/1987 | Rushing et al. | 242/129 |
| 4,728,048 | 3/1988 | Baston | 242/53 X |
| 4,762,286 | 8/1988 | Crow | 242/47 |
| 4,821,974 | 4/1989 | Poehlein | 242/129.51 X |

FOREIGN PATENT DOCUMENTS

| | | | |
|---|---|---|---|
| 1426371 | 12/1964 | France | 242/129.51 |

*Primary Examiner*—Daniel P. Stodola
*Assistant Examiner*—Michael R. Mansen
*Attorney, Agent, or Firm*—William H. Maxwell

[57] ABSTRACT

A winder for mono-filament weed cutter line from a bulk supply and into a dispenser used in weed cutter machines, accomodating both internal and external withdrawal types of packaging, featuring cone-shaped members adapting to varied configurations of cutter line packaging and spools therefor, arranged to avoid entanglement.

10 Claims, 2 Drawing Sheets

MONO FILIMENT DISPENSER SPOOL WINDER

BACKGROUND OF THE INVENTION

This invention relates to the winding of packaged mono filament weed cutter line onto dispensing spools as they are employed in motor driven weed trimmers. The line used is usually of Nylon (TM) or the like and of a diameter to be rather stiff, though somewhat flexible. The dispensing spool is removable from the weed trimmer machine and usually contains about twenty five feet of trimmer line, more or less, and ranging in diameter from 0.065 to 0.095 of an inch. Due to the stiffness and difficulty in properly handling this rather stiff and heavy trimmer line, spools thereof are sold in a prewound condition, but at considerable cost. Consequently, for those persons who use large quantities of trimmer line, said trimmer line is also sold in bulk form, at a substantial saving, and without a spool. However, the person buying bulk trimmer line must be expert in handling it, since it is prone to tangle and tends to resist tight and compact winding upon the relatively small diameter spools. In practice, the spools are well made to last, are reusable, and with a proper setup it is possible to rewind these spools for repeated use. Accordingly, it is an object of this invention to rewind weed cutter line spools for reuse.

In view to the foregoing it will be understood that there are two areas of concern in the rewinding and reuse of weed trimmer spools. Firstly, the packaging of trimmer line is to be considered, and secondly the adaptation of the various spool configurations is to be considered. Therefore, it is an object of this invention to provide a weed trimmer spool line winder that is universally adaptable to existant trimmer line packaging, and secondly universally adaptable to the varied configurations and sizes of trimmer line dispenser spools.

The trimmer line is a substantially stiff plastic, usually mono filament Nylon (TM), ranging in cross sectional diameter from 0.065 to 0.096 of an inch (approximately). Winding thereof onto a spool is by winding continuous coils onto a hub and confined between side flanges. Packaging thereof is similar, either supplied on replaceable dispenser spools, or upon bulk spools, and more economically without spool support. The non support packaging can be accomplished in at least two ways, one for external withdrawal of trimmer line, and the other for internal withdrawal thereof. That is, a bulk coil of trimmer line is packaged for one or the other withdrawal methods, in a box or the like with appropriate opening features for either one of said withdrawal methods. It is an object of this invention to accept either type of packaging.

The trimmer line dispenser spools are removable from the weed trimmer (not shown) and they are replaceable. Their size and drive features vary with different manufacturers, and some are of more than simple form in order to incorporate other features. However, trimmer spools are characterized by a tubular hub to receive a drive shaft, and with spaced flanges to confine the trimmer line supply. Of course, diameter of the spool varies according to the length of trimmer line to be stored and available. It is an object of this invention to accept the various trimmer spools of the aforesaid standardized configurations, and within a reasonable range of sizes.

And, it is another object of this invention to incorporate into one practical apparatus, each and every one of the aforementioned requirements and structural features that render this invention cost effective in every respect, while providing the user with the assurance of proper winding of mono filament onto said spools.

SUMMARY OF THE INVENTION

The apparatus herein disclosed is universally applicable to bulk trimmer line packaging and to the dispenser spools as they are provided in the types of weed trimmer spools under consideration. As will be described in more detail, bulk packaging of mono filament trimmer line varies from loose coils to those confined between discs or plates for external withdrawal, and those confined within a box or the like for internal withdrawal. Also, the dispenser spool will vary widely in size and drive means configuration. Accordingly, the apparatus referred herein as a Weed Trimmer Spool Line Winder is comprised, generally, of a supply means S to universally accept the presently known and available mono filament bulk packaging, and winder means W to universally accept the presently known and available mono filiment dispenser spools. In practice, these two means are manually operable, the supply means releasably accomodating the aforesaid types and variations of packaging, and the winder means releasably accomodating the aforesaid types and variations of dispenser spools.

The foregoing and various objects and features of this invention will be apparent and fully understood from the following detailed description of the typical preferred forms and applications thereof, throughout which description reference is made to the accompanying drawings.

THE DRAWINGS

Figure 2:
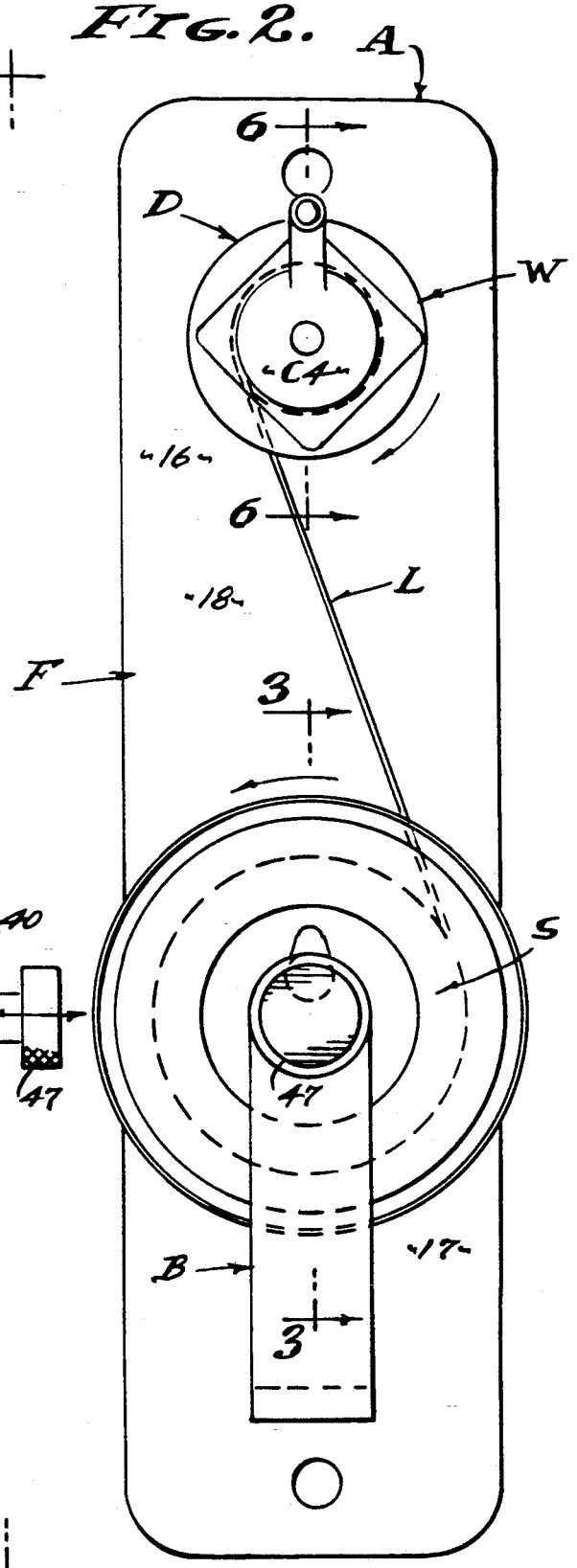
FIG. 2 is a front elevational view taken as indicated by line 2—2 on FIG. 1.
Figure 6:
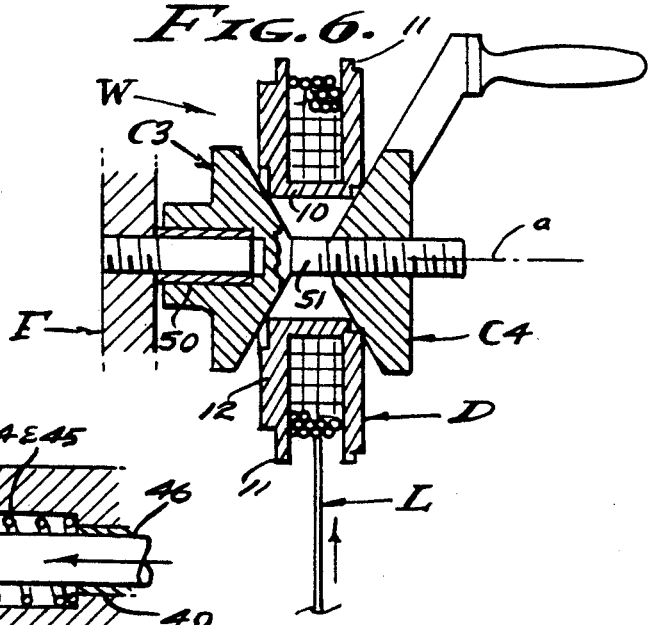

And, FIG. 6 is an enlarged sectional view taken through the winder means as shown by the arrows 6—6 on FIG. 2.

PREFERRED EMBODIMENT

Referring now to the drawings, a typical dispenser spool D is shown comprised of a tubular hub 10 to be rotatably driven on an axis a of a trimmer machine (not shown). At each open end of the hub 10 there is a radial flange 11 between which the mono filament line L is tightly wound, and payed out radially as it is used and requires lengthening. The drive means to the weed trimmer machine will vary and for example is a boss 12 for coupled engagement to the machine drive, the dispenser spool D being captured in working position by a housing that controls and guides the radial discharge of the line; all of which is state of the art. It is a spool of this character that is to be tightly wound with mono filament weed cutter line L, to be wound either clockwise or counter clockwise as may be required. A feature of this line dispenser spool D is that the opposite ends thereof are concentrically symetrical. Accordingly, the winder means W is characterized by opposed cone-shaped positioning members engaged into said opposite ends of the spool D (see FIG. 6).

Figure 3:
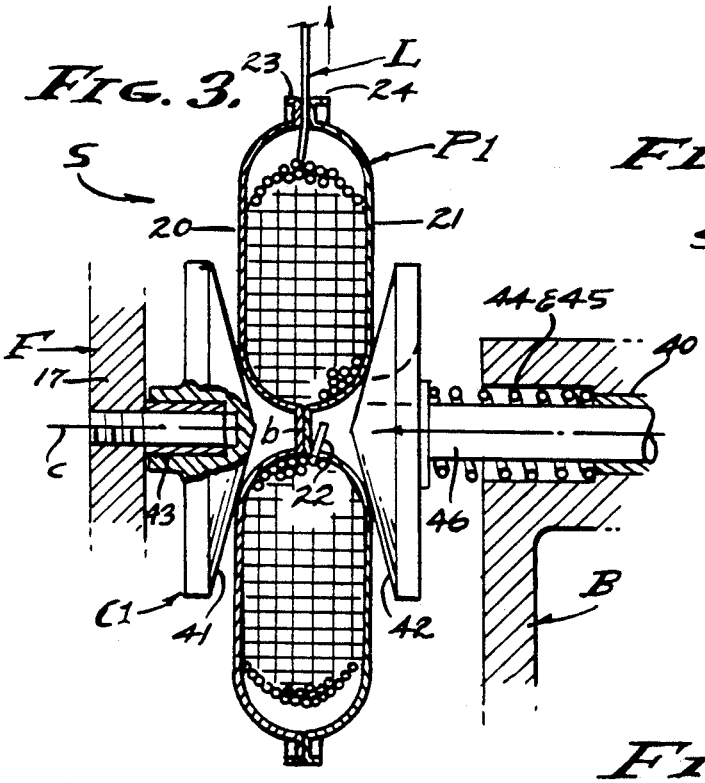
FIGS. 3, 4 and 5 are enlarged sectional views taken through the supply means S as shown by the arrows 3—3 on FIG. 2, FIG. 3 showing packaging with external withdrawal, FIG. 4 internal withdrawal, and FIG. 5 withdrawal from a loose coil.

A typical external withdrawal packaging P1 is shown in FIG. 3, comprised of a pair of opposed plates 20 and 21 between which a coil of mono filament line L is wound and anchored at 22 at the center thereof, the plates being secured one to the other at center plane b. This packaging is symetrical about the center plane b, the plates 20 and 21 forming a toroidal chamber to store the coil of line L, the line being wound from the inside anchor at 22 to the outer periphery where the line L emanates between juxtaposed lips 23 and 24 of said plates, said lips touching and yieldably separable by the line L emanating therebetween. Consequently, line L can be withdrawn from the package by pulling it from between the lips 23 and 24, while permitting rotation of the plates 20 and 21 on its center axis c.

Figure 4:
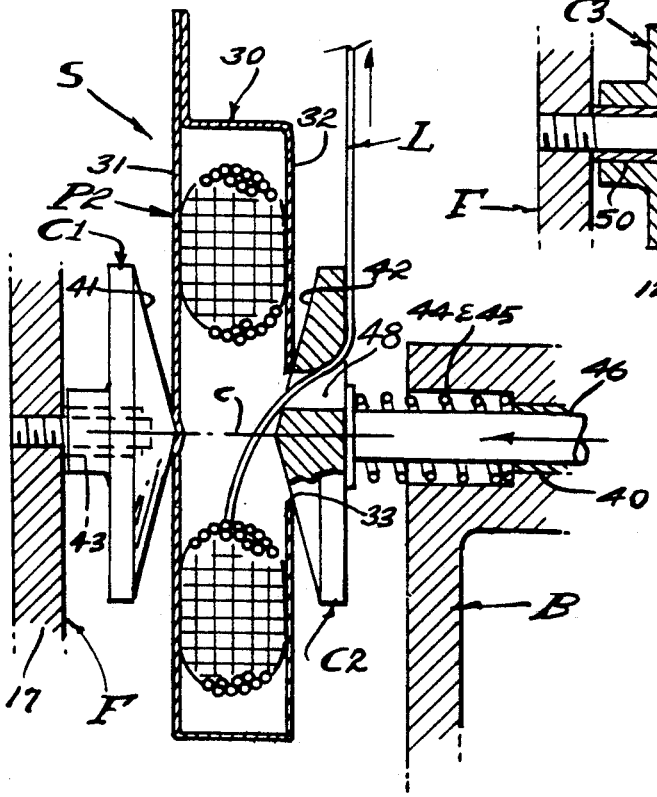

A typical internal withdrawal packaging P2 is shown in FIG. 4, comprised of a box 30 having opposed top and bottom sides 31 and 32 between which a coil of mono filament line L is loosely wound, since it need not be anchored when fully enclosed by the six sides of the box, as shown. This packaging is symetrical about a the central axis c, with the line L wound inwardly from the four tangential outer sides of the box, the line emanating from a central opening 33 on the axis c. The opening 33 is through one side 31 or 32 of the box. Consequently, the line L can be withdrawn from the package by pulling it from the opening 33 without rotating the package.

Figure 5:
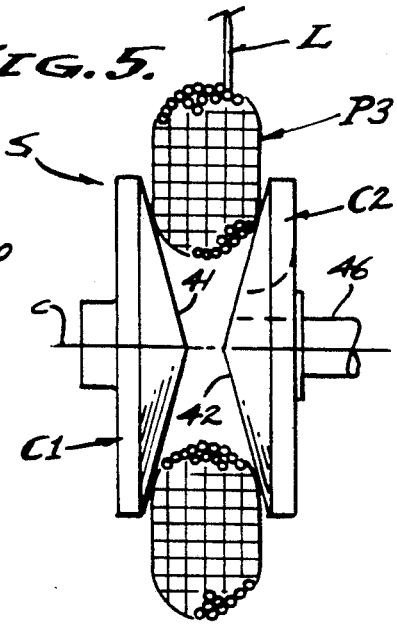

A typical loose external withdrawal packaging P3 is shown in FIG. 5, comprised of a loose coil of mono filament line L, no container therefor being shown. There is no anchor, the line being wound outwardly to emanate tangentially from an outer periphery of the coil thereof. This loose coil is permitted to rotate in order to discharge the mono filament line L.

A feature of the mono filament line L is that it is relatively stiff cutting line that takes a set from the coiled formation from which it is withdrawn in sprial form that tends to tangle when improperly controlled, all of which is taken into account in the functions of the winder next described.

Figure 1:
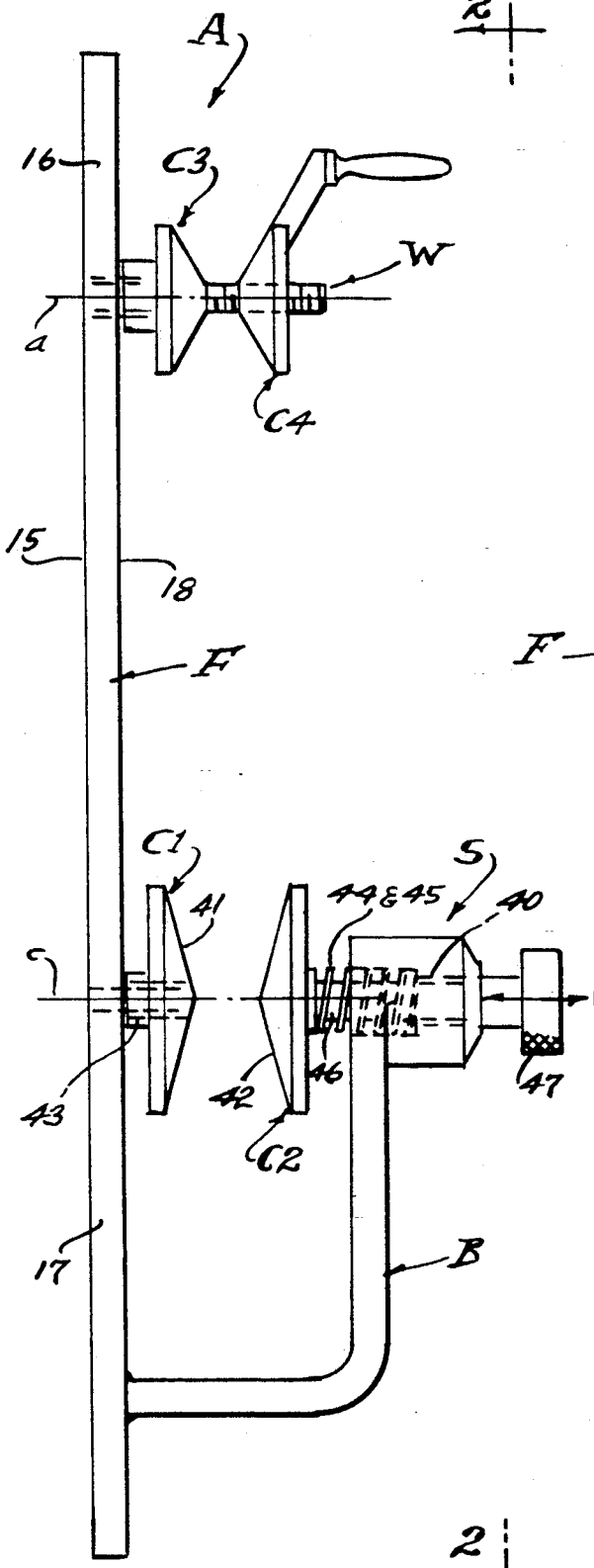
FIG. 1 is a side elevation of a preferred embodiment of the apparatus of the present invention.

The winder apparatus A accomodates any one of the aforesaid types of cutter line packaging P1, P2 and P3, and discharges the cutter line L onto dispenser spools D of normal configuration, without entanglement of said line. As shown in FIGS. 1 and 2 of the drawings, the winder apparatus A involves generally, supply means S for accomodating the cutter line packaging P1, P2 and P3 and for paying out said line, and winder means W for accomodating the dispenser spools D and for tightly winding a supply of cutter line thereon. The means S and W are carried by a frame F for support as may be required. In practice, the frame F can be placed upon and/or secured to a bench or table, or to a wall, or any such stable support.

The frame F is shown as an elongated member having a flat face 15 for its support, and with opposite end portions 16 and 17 to carry the aforesaid supply means S and winder means W. The frame is a rigid structure with mounting holes or the like as may be required.

In accordance with this invention, the supply means S positions cone shaped positioning members C1 and C2 in pressured supporting engagement with the packaging, or directly with the coil of cutter line L (see FIGS. 3, 4 and 5). The means S is disposed on the axis c normal to the front face 18 of the frame at the end portion 17 thereof. A bracket B projects from face 18 at the end of the frame and carries a bearing means 40 on the axis c and in spaced relation to the face 18. The member C1 is carried by the frame F at face 18 with its cone shaped face 41 facing the bearing means 40, and engageable in a concentric center opening in any one of the aforesaid types of packaging, or directly into a coil of cutting line, as may be required. The member C2 is carried by the bracket B with its cone shaped face 42 facing the first mentioned member C1, and also engageable in a concentric center opening in any one of the aforesaid types of packaging, or directly into a coil of cutter line, as may be required. Accordingly, the members C1 and C2 are spaced to oppose the cutter line packaging that is inserted therebetween, as shown.

The cutter line coil and/or packaging P1, P2 or P3 is releasably carried by the supply means S on the axis c so as to be rotatable. To this end, the cone faced member C1 is rotatably carried by bearing means 43 on the axis c, aligned with the bearing means 40 that rotatably carries the cone faced member C2. In accordance with this invention, the members C1 and C2 are biased by spring means 44 to yieldingly press together, thereby engaging the cone faced members into the cutter line packaging or coil, as the case may be, for its rotatable support. As shown, the member C2 is both rotatable and axially slidable in the bearing means 40, there being a compression spring 45 to yieldingly urge the member C2 toward member C1. In carrying out this invention, the member C2 is mounted on a shaft 46 rotatable and axially shiftable in bearing means 40, there being an external control knob 47 for manipulation.

A feature of this invention is the universal accommodation of the different types of cutter line packaging. As shown in FIG. 3, the external withdrawal type of packaging is permitted to turn on axis c by withdrawing the cutter line tangentially and/or radially from between the lips 23 and 24. As shown in FIG. 4, the internal withdrawal type of packaging does not turn, the cutter line L being withdrawn axially of axis c, by means of a cutter line guide opening 48 that extends through the center portion of the cone shaped member C2 and which turns laterally to direct and pay out the cutter line radially offset. As shown in FIG. 5 the external withdrawal of line L is from a simple coil of cutter line held to rotate between the members C1 and C2, the line paying out tangentially therebetween. In each of the aforesaid situations the cutter line L is payed out without entanglement, for direct winding onto the dispenser spool D as next described.

In accordance with this invention, the winder means W positions the cone shaped positioning members C3 and C4 into pressured supporting engagement with the dispenser spool D (see FIG. 6). The means W is disposed or the axis a normal to the front face 18 of the frame at the end portion 16 thereof, and parallel to the axis of the supply means S above described. The member C3 is carried by the frame F by bearing means 50, so as to be free to rotate on axis a, there being a shaft 51 extending axially from the apex of the cone shaped member C3, to carry the opposed cone shaped member C4. The shaft 51 extends through the tubular hub 10 of the spool end threaded to receive the member C4 that is manually turned into pressured engagement against the open end of the bub, so as to clamp it into coupled pressure engagement with the opposed cone shaped member C3. The members C3 and C4 together with the shaft 51 are rotatable as a unit, there being a lever arm and crank handle 52 extending from the member C4, by which said unit with the dispenser spool D are rotated for winding the cutter line L tightly as is required.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

We claim:

1. A weed cutter line dispenser and spool winder apparatus for accomodating mono filament weed cutter line packaging of both external and internal withdrawal types and coils of weed cutter line as well, and for accomodating weed cutter line dispenser spools of varied concentric configurations to be wound with said weed cutter line, and including;

an elongated frame member having opposite end portions with supply means for accomodating both external and internal withdrawal weed cutter line packaging and winding means for accomodating the dispenser spools and supported thereby respectively, the supply means being comprised of separable cone face members on a common central axis, at least one of which is engageable into a side central opening in the packaging to center and hold said packaging for withdrawal of said line therefrom, and one of which has an opening adjacent to and offset from said central axis and extending axially therethrough for internal withdrawal of the weed cutter line from said packaging of the internal withdrawal type.

2. The dispenser spool winder apparatus as set forth in claim 1, wherein the cone faced members of the supply means are opposed and turn on a common axis, one cone faced member being rotatably carried by the frame member and the other cone faced member being rotatably carried by a bracket projecting from and overlying the end portion of the frame member, and wherein the central opening through the said one cone faced member is offset from said axis thereof.

3. The dispenser spool winder apparatus as set forth in claim 1, wherein the packaging has opposite side walls, the cone faced members of the supply means being opposed to said opposite side walls of the packaging and on a common axis, one cone faced member being carried by the frame member and the other cone faced member being carried by a bracket projecting from and overlying the end portion of the frame member, and wherein the opening extending centrally therethrough is turned radially for internal withdrawal of the weed cutter line radially from the packaging thereof.

4. The dispenser spool winder apparatus as set froth in claim 1, wherein the packaging has opposite side walls, the cone faced members of the supply means being opposed to said opposite side walls of the packaging having a central opening from which the weed cutter line is internally withdrawn.

5. The dispenser spool winder apparatus as set forth in claim 1, wherein the cone faced members of the supply means are opposed on a common axis, there being spring means yieldingly urging the opposed cone faced members into pressured engagement with the packaging to releasably secure the same on said common axis.

6. The dispenser spool winder apparatus as set forth in claim 1, wherein the packaging has opposite side walls, the cone faced members of the supply means being opposed to said opposite side walls of the packaging having a central opening from which the weed cutter line is internally withdrawn, the central opening extending through the one cone faced member being turned radially for internal withdrawal of the weed cutter line radially from the central opening of the packaging thereof.

7. The dispenser spool winder apparatus as set forth in claim 1, wherein one of the cone faced members of the winding means is rotatably carried by the frame member and with a shaft extending therefrom and carrying the other cone faced member to rotate therewith against the dispenser spool.

8. The dispenser spool winder apparatus as set forth in claim 1, wherein one of the cone faced members of the winding means is rotatably carried by the frame member and with a shaft extending therefrom and threaded to the other cone faced member for rotation therewith and in clamped engagement with the dispenser spool.

9. The dispenser spool winder apparatus as set forth in claim 1, wherein the drive means rotates one of said cone faced members of the winding means driving the other said cone shaped member through the shaft.

10. The dispenser spool winder apparatus as set forth in claim 1, wherein the drive means rotates both of said cone faced members of the winding means through a shaft interconnecting the same.

* * * * *